United States Patent [19]

Baker

[11] Patent Number: 4,572,236

[45] Date of Patent: Feb. 25, 1986

[54] VALVE STABILIZING CRADLE

[76] Inventor: Richard Baker, 10304 Cherrywood Dr., Richmond, Va. 23233

[21] Appl. No.: 731,044

[22] Filed: May 6, 1985

[51] Int. Cl.[4] ..... F16L 5/00

[52] U.S. Cl. ..... 137/364; 137/366; 137/368; 137/371; 137/315; 251/292; 251/293; 52/20

[58] Field of Search ..... 137/363–372, 137/315; 251/292, 293; 52/20

[56] References Cited

U.S. PATENT DOCUMENTS

| | | | |
|---|---|---|---|
| 43,056 | 6/1864 | Weldon | 137/368 |
| 595,790 | 12/1897 | Smith | 137/365 |
| 613,652 | 11/1898 | Chadbourne | 137/366 |
| 741,477 | 10/1903 | Flinn | 137/366 |
| 1,099,804 | 6/1914 | Johnson et al. | 137/366 |
| 1,578,885 | 3/1926 | Flinn | 137/366 |
| 2,691,384 | 10/1954 | Mueller et al. | 137/366 |
| 3,901,271 | 8/1975 | Stewart | 137/364 |
| 4,308,886 | 1/1982 | Handley et al. | 137/364 |
| 4,310,015 | 1/1982 | Stewart et al. | 137/364 |
| 4,331,178 | 5/1982 | Handley et al. | 137/366 |

*Primary Examiner*—A. Michael Chambers
*Attorney, Agent, or Firm*—Norman B. Rainer

[57] ABSTRACT

A cradle device of integral construction provides stable support for an underground curb cock positioned at the bottom of a vertical curb box conduit. The device embraces the curb cock, thereby preventing its movement and maintaining its valve stem in an upright position so that it can be engaged by a long stemmed key. The device also provides secure footing for the curb box conduit.

4 Claims, 4 Drawing Figures

VALVE STABILIZING CRADLE

BACKGROUND OF THE INVENTION

This invention concerns the positional stabilization of underground valves associated with buried gas and water pipes, and more particularly concerns apparatus which facilitates manipulative control of such valves by elongated devices which extend downwardly from ground level to engagement with the valve.

Pipelines that carry water and gas to residential and industrial buildings are generally located underground, usually at below-frostline depths of three to four feet. On-off control valves are generally positioned adjacent to the property line of each building served by the pipeline, said valves having an upwardly directed valve stem. A vertical conduit, usually of 4" to 8" diameter, and referred to as a "curb box" extends between the valve and the surface of the terrain to provide accessability to the valve. A horizontally disposed lid at the upper extremity of the curb box protects the conduit passageway.

The ground in which the valve sits is usually disturbed ground, namely ground which has been backfilled during the construction of the building or installation of the pipelines. Consequently, the valve is not held securely enough by the surrounding soil to support the valve and maintain the stem in perfectly upright orientation. Factors such as soil erosion, water infiltration, stresses imparted by the pipeline, and the downward force of the curb box or forces applied thereto contribute further to the insecure positioning of the valve. The possible dislocations of the valve include rolling movement around the pipe axis, tilting movement within the vertical plane of the pipe axis, twisting within the horizontal plane of the pipe axis caused by operating the valve stem, and vertical downward motion. For example, if a vehicle drives over the curb box lid, it can cause a poorly supported valve to be pushed downward to the extent of pinching off the pipeline. This is especially likely if the pipeline is fabricated of a plastic easily affected by deformational stresses.

The valve, generally referred to as a "curb cock" if it carries gas, is comprised of an elongated valve stem of circular cross-section vertically disposed within a housing provided with horizontally disposed round ports adapted to receive incoming and outgoing pipelines. The housing is generally downwardly tapered from an uppermost circular outer shoulder. The uppermost portion of the valve stem is provided with an engagement head having an elongated or square configuration. The lowermost extremity of the valve stem protrudes below the valve housing. To operate the valve in its on-off function, a long stemmed tool called a "key", and having an elongated or square slot or fork at its lowermost extremity, is lowered through the curb box to engage the head of the valve stem. The valve stem is then rotated about 90° about its vertically disposed rotational axis.

If the valve stem is not perfectly upright, it cannot be engaged by the key. Even if the key engages the valve stem, rotation of the valve stem may not be achievable if the valve and adjacent pipe move when torque force is applied. In the case of plastic pipe, forceful twisting of the valve could crimp the pipe.

Various expedients have been disclosed for stabilizing the position of the aforesaid underground valves. Bricks, supporting pipes, and other materials and structures have been utilized in a bolstering manner. However, such expedients have generally provided buttressing support with respect to only one or two of the several modes of potential movement of the valve, and usually do not accommodate the access conduit.

It is accordingly an object of the present invention to provide a device for stabilizing an underground valve with respect to its several potential modes of movement.

It is another object of this invention to provide a device as in the foregoing object which engages the lower extremity of the curb box associated with said valve in centered relationship to said valve.

It is a further object of the present invention to provide an improved device of the aforesaid nature of simple and rugged construction which may be economically manufactured.

These objects and other objects and advantages of the invention will be apparent from the following description.

SUMMARY OF THE INVENTION

The above and other beneficial objects and advantages are accomplished in accordance with the present invention by a cradle device for a curb cock comprised of a housing having an outwardly protruding uppermost circular shoulder and a valve stem provided with an uppermost engagement head, said cradle device being of integral monolithic construction and comprising:

(a) a base portion adapted to be horizontally disposed, having an upper surface, flat lower surface, and centered circular aperture, (b) an elongated upwardly opening trough defined by paired parallel walls rising upwardly from the upper surface of said base portion and positioned such that said circular aperture is centered on the midpoint of the longitudinal axis of said trough, the width of said trough, measured between facing surfaces of said walls, being such as to closely accommodate a curb cock and pipes associated therewith, (c) four narrow slots vertically disposed in said walls in paired relationship in a circular locus centered upon said circular aperture, said slots being adapted to seat the lowermost extremity of a curb box of circular contour, and (d) two identical wide slots positioned in said walls in opposition about the midpoint of said trough and adapted to accommodate the outwardly protruding shoulder of said housing.

In a preferred embodiment of the invention, the base portion has a rectangular configuration elongated in the direction of the trough. The four narrow slots are preferably diagonally cut with respect to the walls of the trough in order to more closely conform to the circular sidewall of the curb box.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
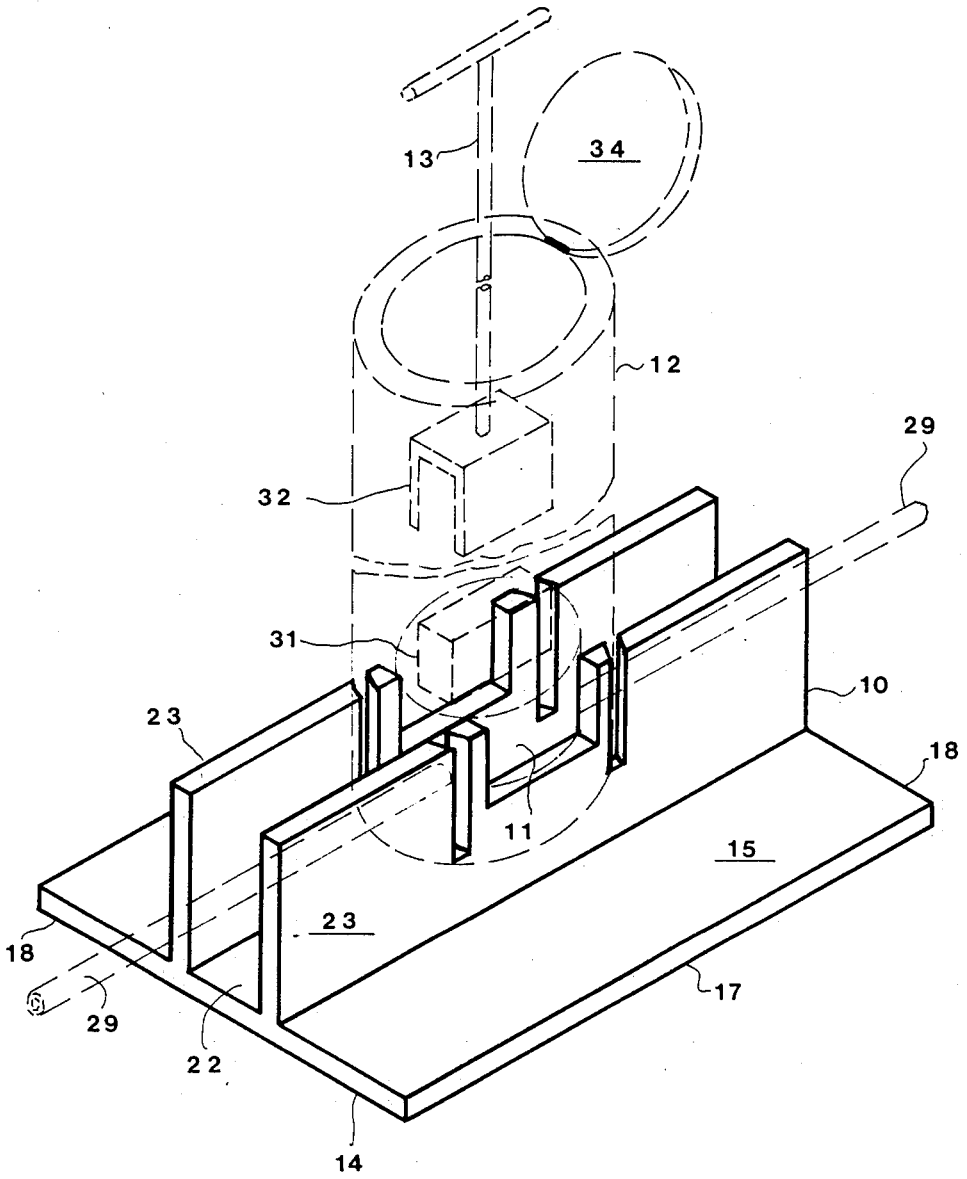
FIG. 1 is a perspective view of an embodiment of a cradle device of the present invention shown in association with a buried curb cock and pipeline and associated curb box and key.
Figure 2:
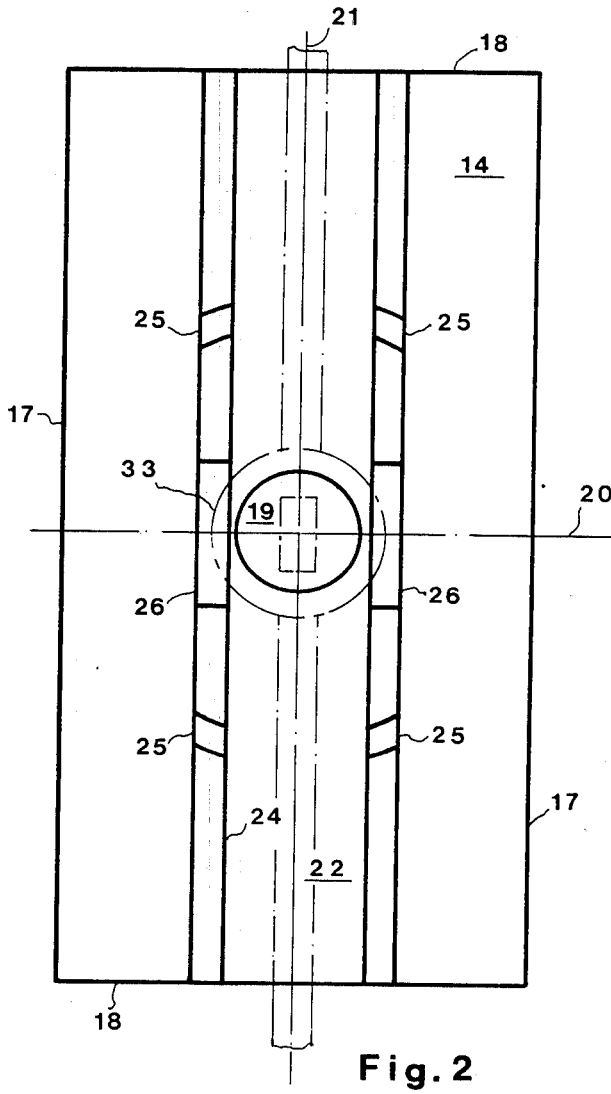
FIGS. 2, 3 and 4 are respectively, top plan, end, and side views of the device of FIG. 1.
Figure 4:
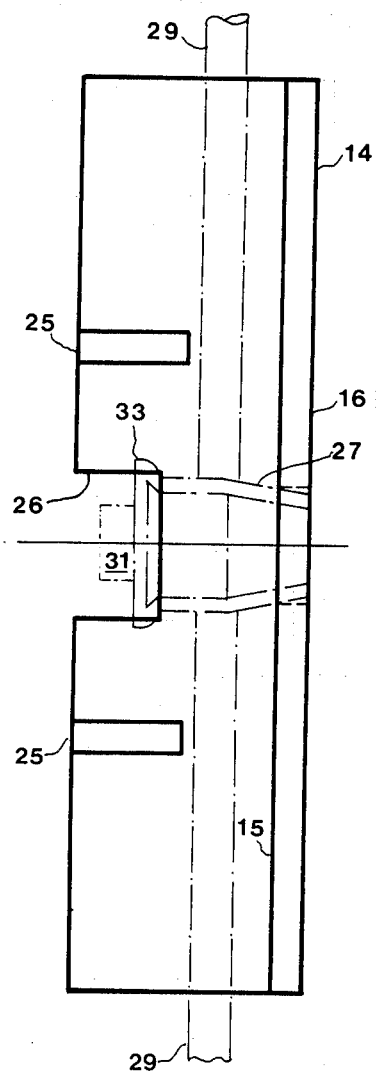
Figure 3:
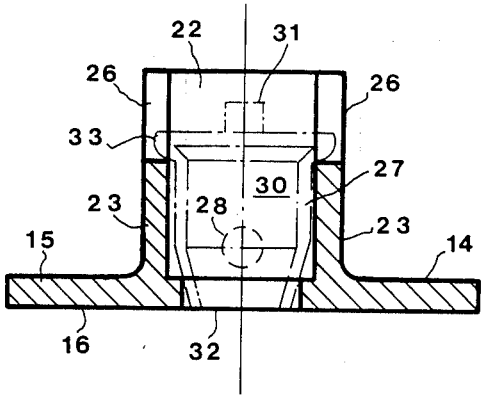

Referring to the drawing, a cradle device 10 of the present invention is shown in operative association with curb cock 11, curb box 12 vertically positioned upon the cradle device, and key 13 adapted to reach downwardly to engage and manipulate the valve. The upper extremity of curb box 12 is provided with hinged lid 34.

The cradle device is an integral monolithic structure which may be fabricated of a thermoplastic synthetic polymer such as ABS (acrylonitrile-butadiene-styrene), polyethylene, polypropylene, polyamide, polyurethane, polyacetal, thermoset plastics, fiberglass-filled resins, composites, and metals. Fabrication of the device may be achieved by injection molding, casting, extrusion, or stamping. The cradle device is comprised of base portion 14, having flat upper and lower surfaces 15 and 16, respectively, a rectangular periphery defined by parallel long edges 17 and parallel short edges 18, and circular aperture 19 centered at the midpoint of the rectangular periphery, said midpoint being defined by the intersection of lateral and longitudinal axes 20 and 21, respectively.

An elongated, upwardly opening trough 22 extends upwardly from upper surface 15, said trough being defined by paired parallel walls 23 equally disposed about longitudinal axis 21.

Four narrow slots 25 are vertically disposed in walls 23 in paired relationship in a circular locus centered upon aperture 19. Said slots are angled with respect to the interior surfaces 24 of walls 23 in a manner such that lines drawn from the center axes of a pair of said slots intersect on lateral axis 20.

Two identical wide slots 26 are positioned in said walls in opposition about longitudinal axis 21, and centered upon lateral axis 20.

The curb-cock valve 11 is comprised of housing 27 having opposed circular ports 28 adapted to receive pipeline 29, and outwardly protruding upper shoulder 33. An elongated valve stem 30 of conical configuration is vertically disposed within said housing. The uppermost extremity of the valve stem is provided with a head in the form of elongated bar or square 31. The lowermost extremity 32 of the valve stem protrudes below the housing.

When properly emplaced, the valve rests within trough 22 in a manner such that housing 27 is in abutment with interior faces 24 of walls 23, the lowermost extremity of the valve stem resides within aperture 19, and uppermost circular outer shoulder 33 of said housing resides partially within the space of wide slots 26. In such manner of installation, the valve is prevented from moving in any direction and head bar 31 is held perfectly erect to permit engagement by a groove 32 at the lowermost extremity of key 13.

While particular examples of the present invention have been shown and described, it is apparent that changes and modifications may be made therein without departing from the inverntion in its broadest aspects. The aim of the appended claims, therefore, is to cover all such changes and modifications as fall within the true spirit and scope of the invention.

Having thus described my invention, what is claimed is:

1. A cradle device for a curb cock comprised of a housing having an outwardly protruding uppermost circular shoulder and a valve stem provided with an uppermost engagement head, said cradle device being of integral monolithic construction and comprising:

(a) a base portion adapted to be horizontally disposed, having an upper surface, flat lower surface, and centered circular aperture, (b) an elongated upwardly opening trough defined by paired parallel walls rising upwardly from the upper surface of said base portion and positioned such that said circular aperture is centered on the midpoint of the longitudinal axis of said trough, the width of said trough, measured between facing surfaces of said walls, being such as to closely accommodate a curb cock and pipes associated therewith, (c) four narrow slots vertically disposed in said walls in paired relationship in a circular locus centered upon said circular aperture, said slots being adapted to seat the lowermost extremity of a curb box of circular contour, and (d) two identical wide slots positioned in said walls in opposition about the midpoint of said trough and adapted to accommodate the outwardly protruding shoulder of said housing.

2. The cradle device of claim 1 wherein the base portion has a rectangular configuration elongated in the direction of the trough.

3. The cradle device of claim 1 wherein said four narrow slots are diagonally disposed with respect to the walls of the trough.

4. The cradle device of claim 3 wherein said narrow slots are disposed in a manner such that straight lines drawn through the centers of a pair of said slots within the same wall will intersect on a lateral axis that perpendicularly intersects said longitudinal axis at the center of said circular aperture.

* * * * *